US010182489B1

(12) United States Patent
Israni

(10) Patent No.: US 10,182,489 B1
(45) Date of Patent: Jan. 15, 2019

(54) WIRELESS LIGHT ASSEMBLY AND KIT

(71) Applicant: Trendstar Corporation, Fairfield, NJ (US)

(72) Inventor: Rajesh Israni, Fairfield, NJ (US)

(73) Assignee: TRENDSTAR CORPORATION, Fairfield, NJ (US)

( * ) Notice: Subject to any disclaimer, the term of this patent is extended or adjusted under 35 U.S.C. 154(b) by 0 days.

(21) Appl. No.: 15/795,717

(22) Filed: Oct. 27, 2017

(51) Int. Cl.
*H05B 33/08* (2006.01)
*H05B 37/02* (2006.01)
*F21K 9/20* (2016.01)
*F21V 15/01* (2006.01)

(52) U.S. Cl.
CPC ..... *H05B 37/0272* (2013.01); *F21K 9/20* (2016.08); *F21V 15/01* (2013.01); *H05B 33/0842* (2013.01)

(58) Field of Classification Search
CPC ..... H05B 37/0272; H05B 37/0227; H05B 33/0842; F21K 9/20; F21V 15/01
USPC ..... 315/291, 294, 191, 224, 307
See application file for complete search history.

(56) References Cited

U.S. PATENT DOCUMENTS 8,884,531 B1 * 11/2014 Xu ..... H05B 33/0803 315/153
8,901,827 B1 * 12/2014 Xu ..... F21S 9/037 315/153
2005/0094387 A1 * 5/2005 Coman ..... F21S 9/022 362/153
2010/0296285 A1 * 11/2010 Chemel ..... F21S 2/005 362/235
2011/0062888 A1 * 3/2011 Bondy ..... H05B 33/0815 315/294
2012/0134133 A1 * 5/2012 Kang ..... F21V 3/00 362/84
2012/0262928 A1 * 10/2012 Matsuda ..... F21S 8/026 362/373
2013/0030423 A1 * 1/2013 Reichert ..... A61N 5/0616 606/9
2013/0342131 A1 * 12/2013 Recker ..... H05B 33/0842 315/292
2015/0220109 A1 * 8/2015 von Badinski ..... G01P 15/00 340/539.12
2016/0313636 A1 * 10/2016 Chien ..... G03B 29/00
2016/0330825 A1 * 11/2016 Recker ..... H05B 37/0272

* cited by examiner

*Primary Examiner* — Douglas W Owens
*Assistant Examiner* — Syed M Kaiser
(74) *Attorney, Agent, or Firm* — Leason Ellis LLP

(57) ABSTRACT

A wireless light kit includes a wireless light unit that comprises a housing having an interior compartment that contains a processor and a power source and a light source that is powered by the power source and operatively connected to the processor. The kit also includes two different types of mounting back plates, namely a first back plate and a second back plate. The first back plate is configured to mate with the housing so as to cover at least a portion of the rear face of the housing and provide a mounting surface for mounting to a support surface, such as a wall. The second back plate is configured to mate with the housing so as to cover at least a portion of the rear face of the housing and further includes a stake extending outwardly therefrom and being configured for insertion into a ground surface for supporting the wireless light unit above the ground surface.

20 Claims, 11 Drawing Sheets

WIRELESS LIGHT ASSEMBLY AND KIT

TECHNICAL FIELD

The present invention is directed to the field of lighting and more particularly, to a wireless light assembly (a sensor device) and kit that is configured to direct light in a fixed direction and also is configured to be secured to both a support surface, such as a wall or stair, and to a stake for placement in the ground in an outdoor setting or in an indoor garden setting. The light assembly can also be actuated based on sensor information, such as sensing motion or sensing light or the lack thereof (such as a dusk to dawn setting).

BACKGROUND

There are many different types of lights that are commercially available and can be grouped according to their intended uses. For example, there is indoor lighting, outdoor lighting, specialty lighting, etc. Lighting can also be grouped by the power source in that many lights have an electric power source, such as a standard wall outlet; however, there are also many types of lighting that are battery powered.

Another class of lighting is motion activated lighting which can serve both a safety and security function. For example, motion activated lights can be used to guide a person in the middle of the night within the house or can be located outside to guide a person along a pathway or the like.

While there are many wireless motion activated lights on the market what is needed is an improved wireless light assembly/device that can be easily mounted to not only a support surface but also to a garden stake that allows placement within the ground at a select outdoor location.

SUMMARY

In accordance with one embodiment, a wireless light is provided and includes a housing having an interior compartment that contains electronics and a power source. Along a bottom of the housing, a ledge is formed and when the housing is oriented in a vertical position, there is an inner wall adjacent to and overhanging the ledge. The light also includes a light source positioned along the ledge and configured to emit light in an outward direction from the ledge. The inner wall is positioned and constructed so as to deflect the emitted light in a downward direction that is away from the inner wall. In other words, the housing is configured to be a light directive housing.

In yet another aspect, a wireless light kit includes a wireless light unit that comprises a housing having an interior compartment that contains a processor and a power source and a light source that is powered by the power source and operatively connected to the processor. The kit also includes two different types of mounting back plates, namely a first back plate and a second back plate. The first back plate is configured to mate with the housing so as to cover at least a portion of the rear face of the housing and provide a mounting surface for mounting to a support surface, such as a wall. The first back plate is particularly adapted for use in an indoor setting such as being mounted to a wall or staircase. The second back plate is configured to mate with the housing so as to cover at least a portion of the rear face of the housing and further includes a stake extending outwardly therefrom and being configured for insertion into a ground surface for supporting the wireless light unit above the ground surface. The second back plate is particularly adapted for use in an outdoor setting such as being inserted into a ground surface along a path or in landscaping.

BRIEF DESCRIPTION OF THE DRAWING FIGURES

DETAILED DESCRIPTION OF CERTAIN EMBODIMENTS

As previously mentioned and with reference to the accompanying drawings, the present invention relates to a wireless light assembly 100 that is configured for attachment to a support surface, such as a wall or a back of a stair, and also can be inserted into the ground when the optional stake type back plate is used as described herein.

Figure 1:
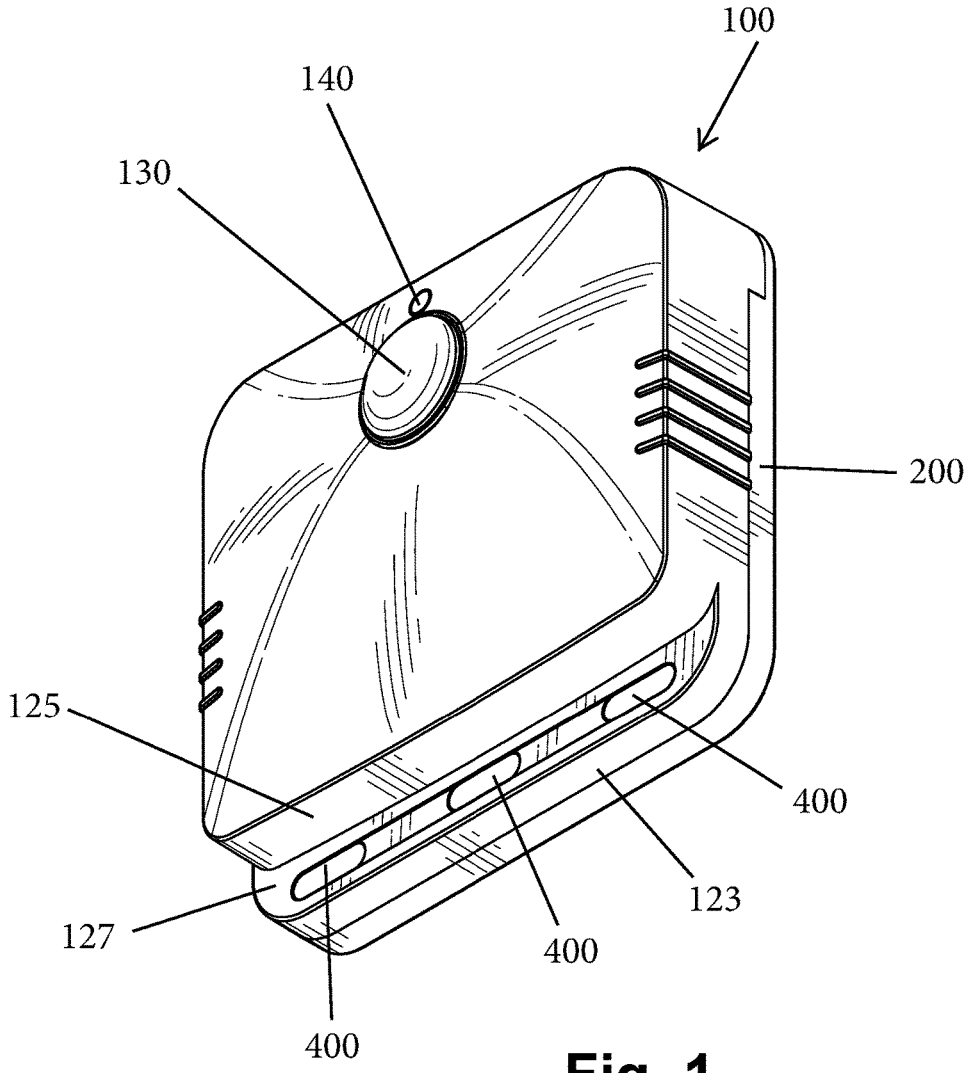
FIG. 1 is a front, bottom and side perspective view of a wireless light assembly (device) according to one embodiment of the present invention shown in its assembled state.
Figure 2:
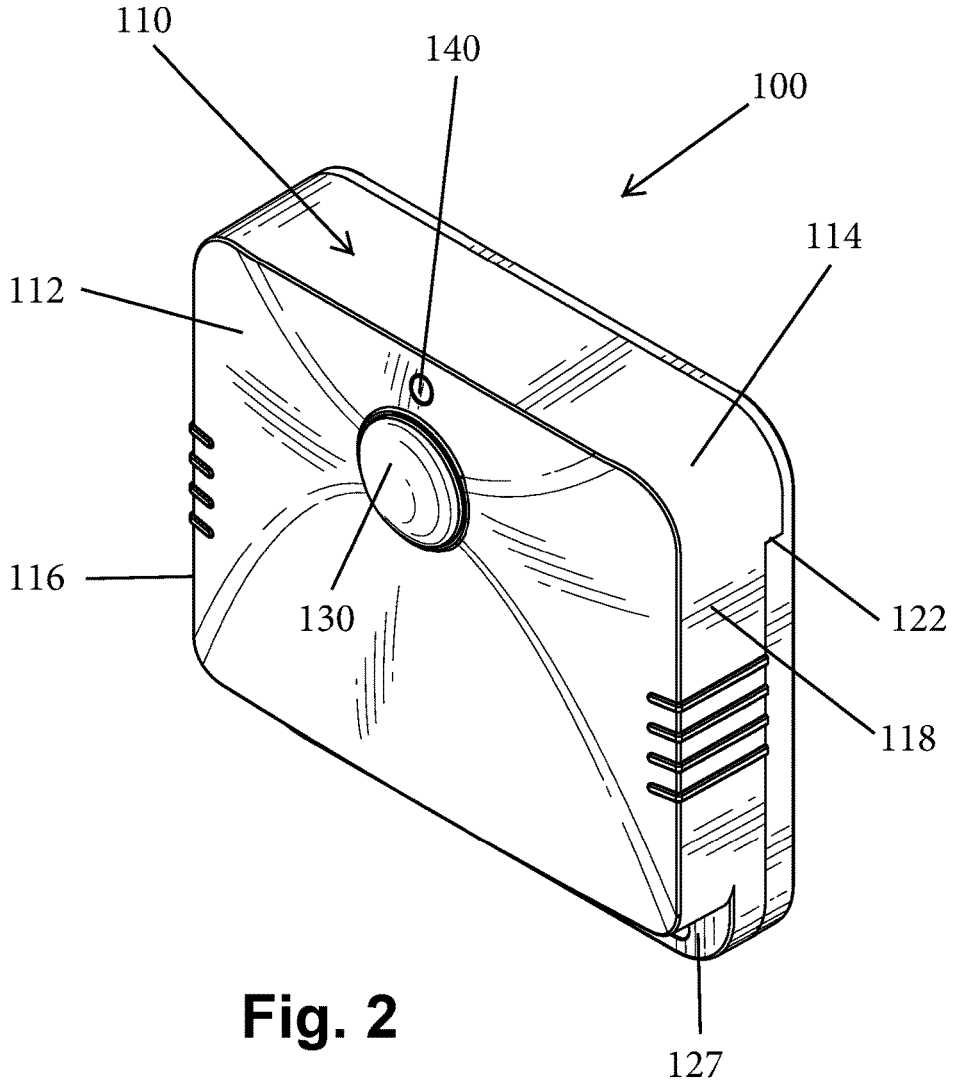
FIG. 2 is a front and side perspective view of the wireless light assembly.
Figure 3:
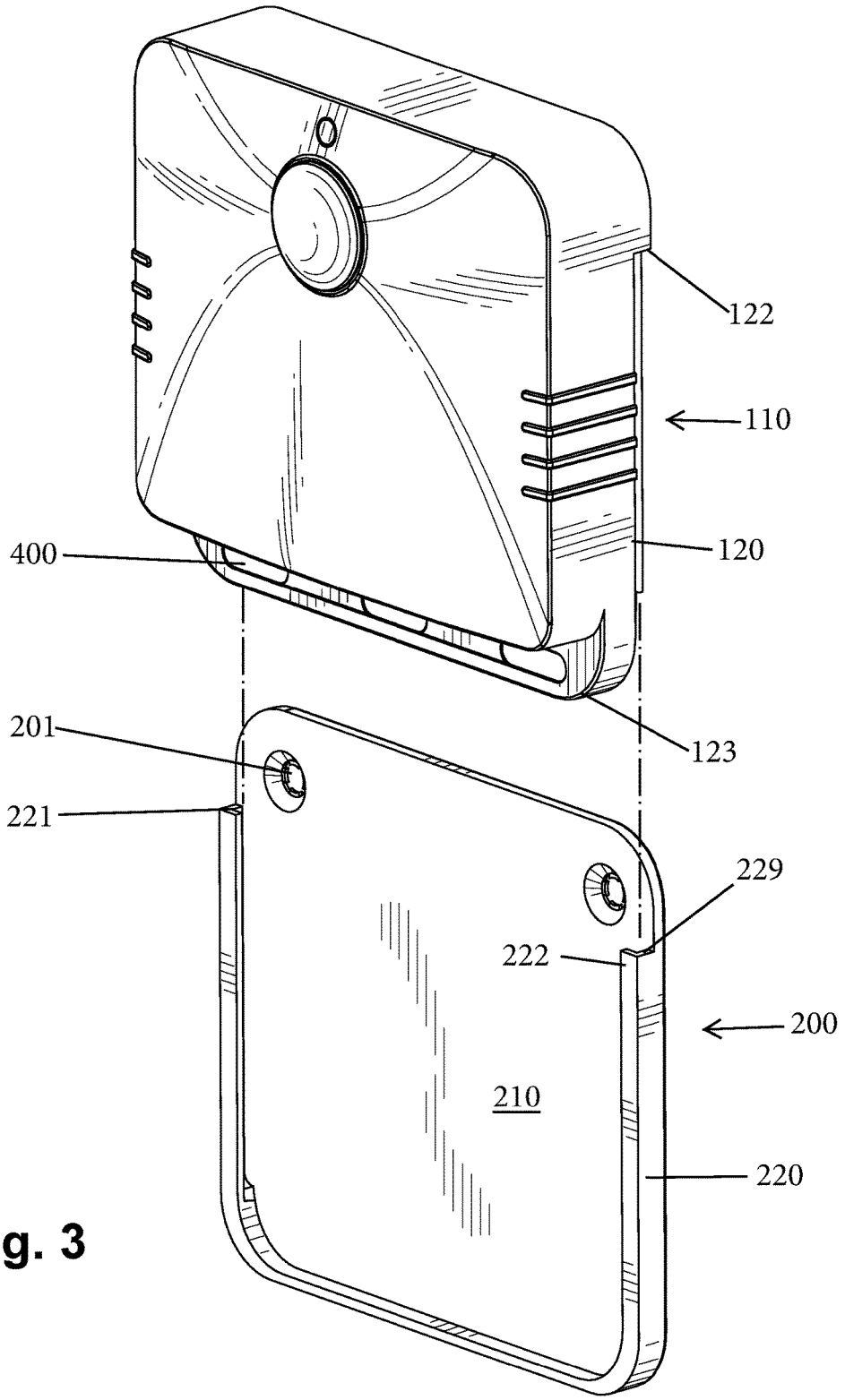
FIG. 3 shows a housing of the light assembly exploded from an attachable back plate.
Figure 4:
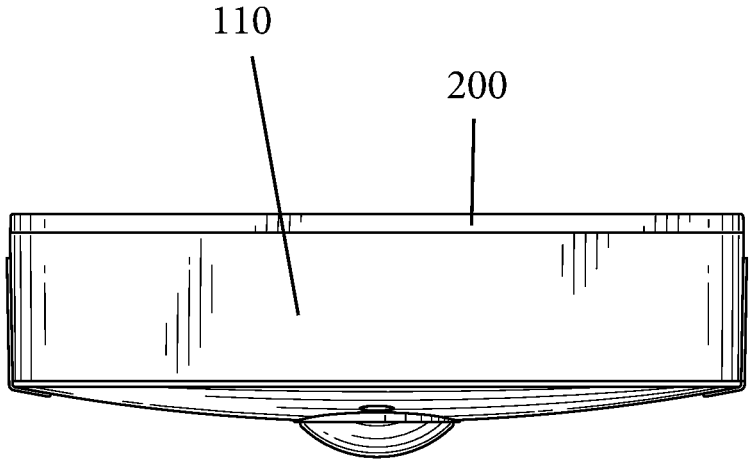
FIG. 4 is a top plan view of the light assembly.
Figure 5:
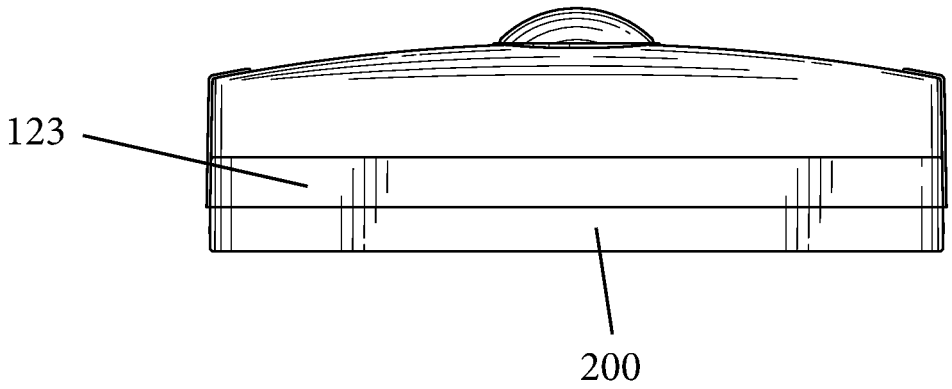
FIG. 5 is a bottom plan view of the light assembly.
Figure 6:
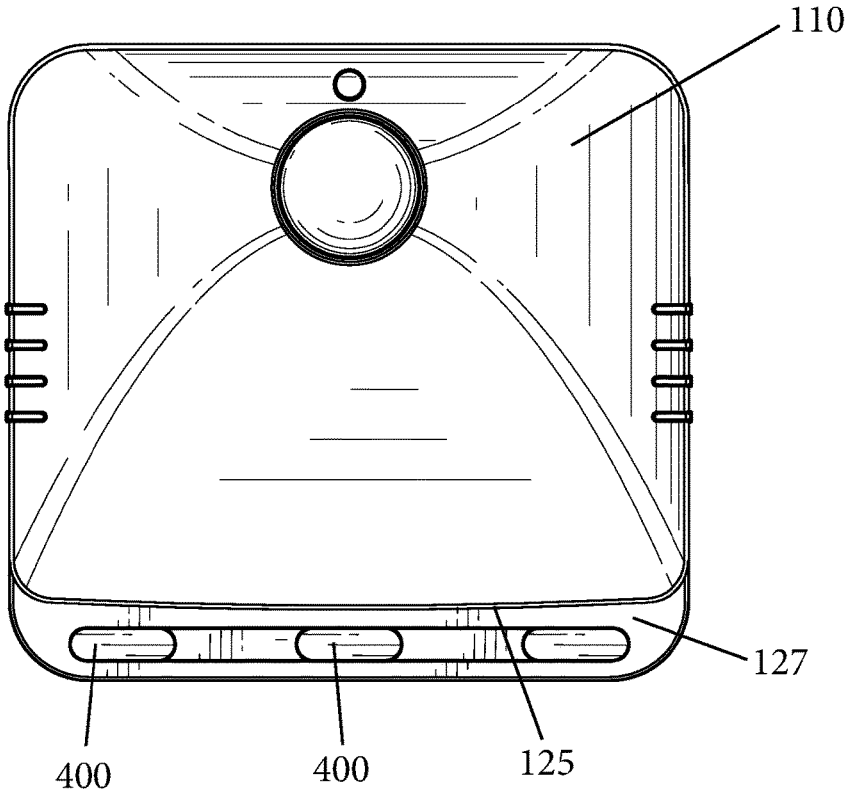
FIG. 6 is a front elevation view of the light assembly.
Figure 10:
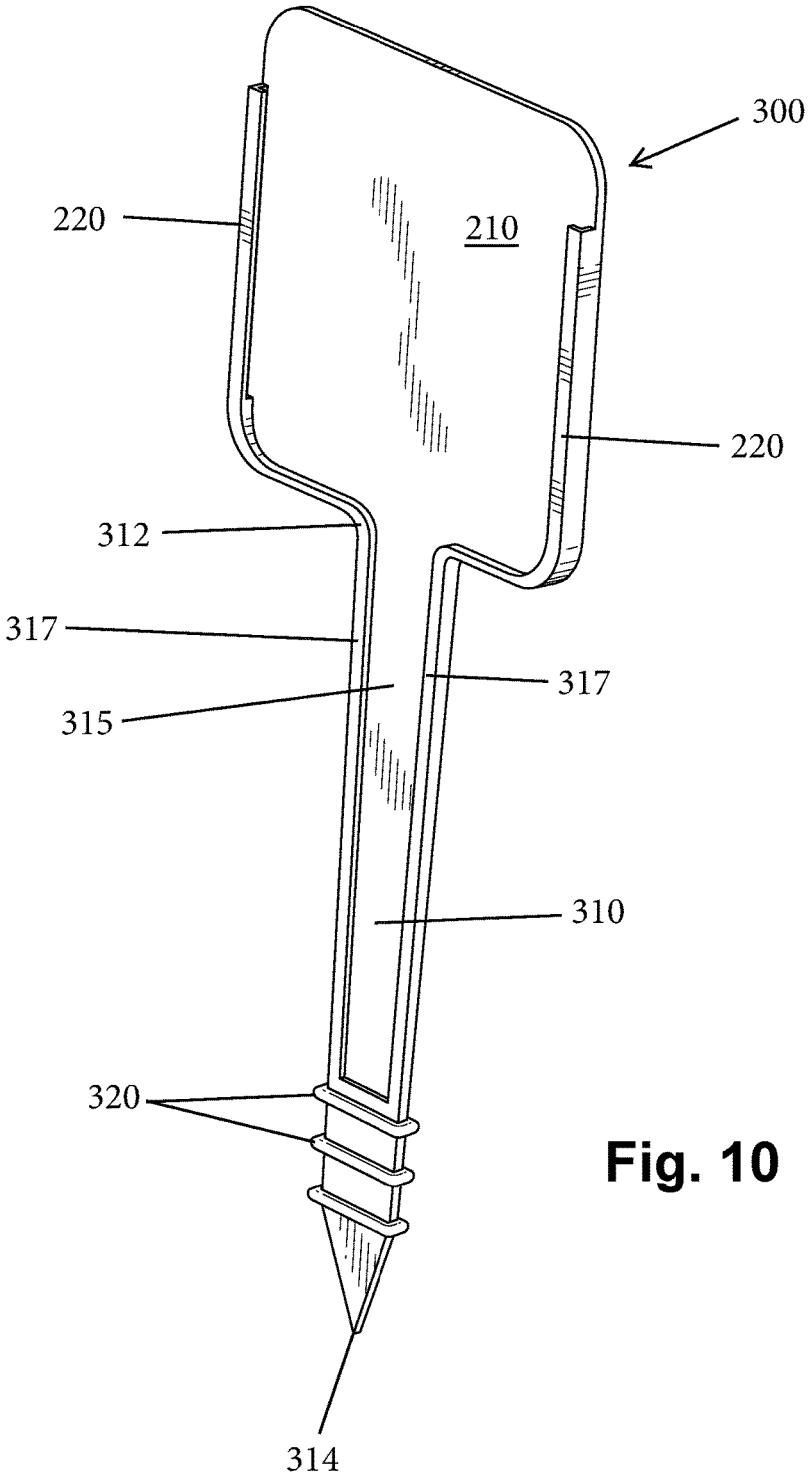
FIG. 10 is a perspective view of an alternatively attachable back plate including an integral stake element.

The wireless light assembly 100 includes a main unit or housing 110 and an attachable back plate which can either be in the form of a simple back plate 200 as shown in FIG. 3 or can be in the form of a stake type back plate 300 shown in FIG. 10.

The main housing 110 is broadly the structure that houses all of the electronics and the power source. The main housing 110 is thus a sealable structure that includes a hollow interior compartment that contains the electronics and the power source.

In one embodiment, the main housing 110 has a front wall 112, a top wall 114, a first side wall 116 and a second side wall 118. While the main housing 110 is shown as having a generally square shape, it will be appreciated and understood that the main housing 110 can be formed to have any number of different shapes, including but not limited to a rectangle, etc. One or more of the corners of the main housing 110 can be curved.

Figure 11:
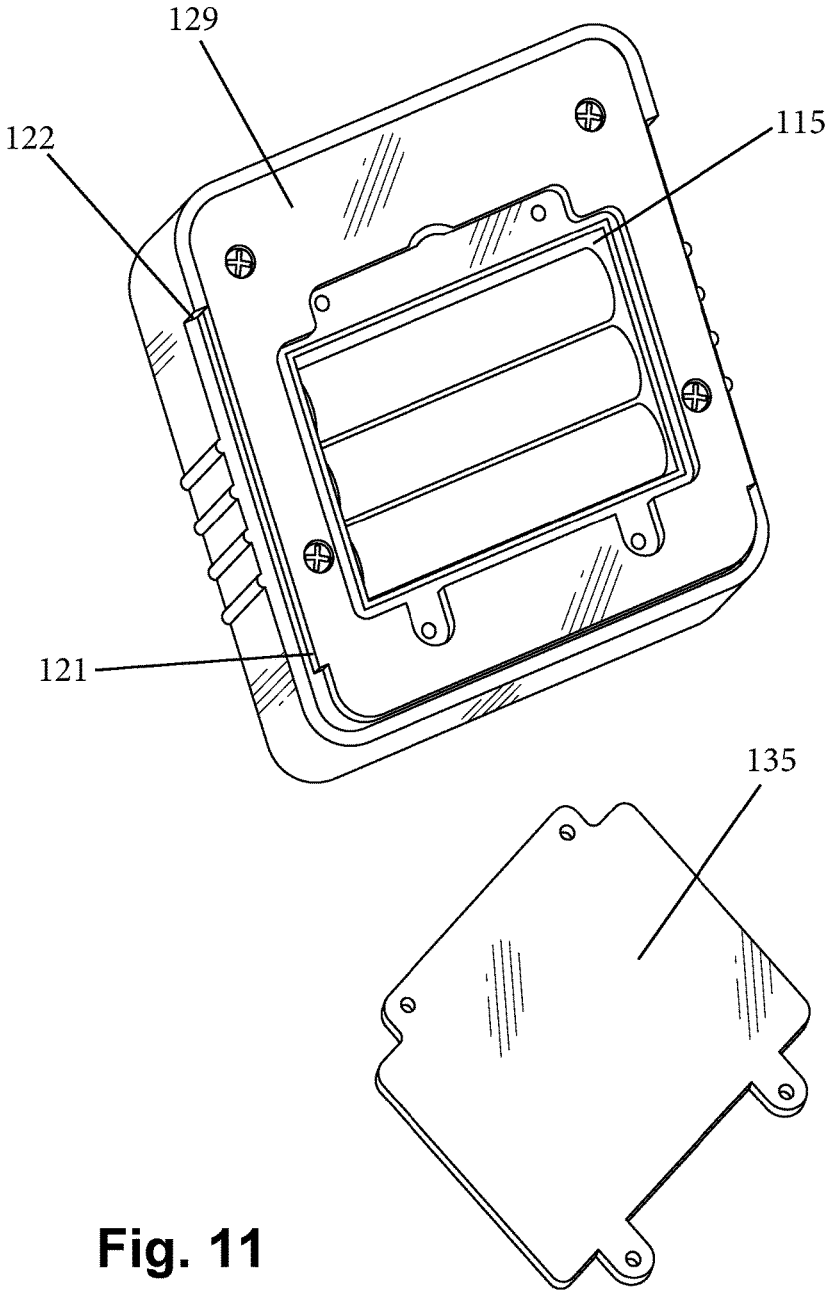
FIG. 11 is a rear perspective view of a housing of the wireless light assembly with a battery cover shown exploded therefrom.

As shown, the front wall 112 can have a curved outer surface or it can be constructed so as to planar. Along rear edges of each of the side walls 116, 118, there is a notch or cutout 120 that serves as a guide as described herein. An upper end of the cutout 120 comprises a closed end in that there is a stop (wall) 122 located thereat. The cutouts 120 have a linear construction and are parallel to one another. The housing also has a pair of guide rails 121 that are formed along opposing sides of the housing as shown in FIG. 11. The guide rails 121 are accessible due to the presence of the cutout 120.

A bottom of the main housing 110 is configured to contain a light source 400 and as shown, the bottom can have a stepped construction in that a bottom wall 123 defines the bottommost portion of the main housing 110 and defines the rear face of the main housing 110. An inner wall 125 is also formed and is spaced from the bottom wall 123 and can be located parallel thereto. A right angled shoulder can be defined between the inner wall 125 and the bottom wall 123.

The bottom wall 123 can thus be thought of as defining a ledge 127 since it extends below the inner wall 125. The ledge 127 can be a planar surface that faces forwardly when the light assembly 100 is oriented vertically, which is a normal in-use position. In this vertical orientation, the inner wall 125 creates an overhang relative to the light source 400 which is located along the ledge 127 and more particularly, an underside of the inner wall 125 is positioned above the light source 400. For example, one or more lights 400, such as LEDs, can provided along the ledge 127 and oriented so as to project light in an outward (forward) direction from the ledge 127. In the illustrated embodiment, there are a plurality (e.g., three) of light sources (LEDs) 400 that are spaced across the ledge 127.

It will be understood that inner wall 125 is formed and positioned relative to the light source 400 so as provide a light deflection function. In particular, as light emanates from the light source 400 (e.g., LEDs), the light waves expand outwardly at different angles as the light waves travel away from the light source 400. As a result, some of the light waves from each LED contact the inner wall 125 (i.e., the underside thereof) and are deflected in a downward direction since the inner wall 125 acts as a deflector (barrier). This action is desirable since the light assembly 100 is intended to cast light outward to assist a person in seeing the area at which the light assembly 100 is mounted. For example, when the light assembly 100 is mounted along a staircase, it is intended to illuminate one or more stairs, when mounted in a closet, it is intended to illuminate the closet, when mounted in a hallway, it is intended to illuminate the floor, etc.

In this manner each LED 400 is designed to cast light not only forward but also in a downward direction so as to illuminate a greater area around the light assembly 100.

As shown in FIG. 11, a rear wall 129 of the main housing 110 can include a removable cover or panel 135 that provides access to a battery compartment 115 to allow for insertion and removal of the batteries 119. This cover/panel 135 can be attached to the housing 110 using any number of conventional techniques, including but not limited to the use of fasteners, such as screws, etc. The cover/panel 135 can be countersunk so that it is flush to the surrounding sections of the main housing 110 so as to provide a clean, planar rear face of the main housing 110. A seal member, such as a gasket or O-ring, can be provided as well to establish a seal between the cover/panel 135 and the main housing 110. Alternatively, the battery compartment 115 can be left open along the rear 129 of the main housing 110 and the back plate 200, 300 serves to close off and seal the battery compartment.

As mentioned, the hollow interior of the main housing 110 contains the electronics and power source. Exemplary electronics include but are not limited to a processor, such as a printed circuit board (PCB), wiring connecting the PCB to the power source which comprises one or more batteries 119. One or more switches, such as an on/off switch, are also provided. In addition, the electronics also preferably contain one or more sensors for actuating the light assembly 100 under select conditions. For example, when a motion sensor 130 is provided, the light assembly 100 will only turn on when motion is sensed in proximity to the motion sensor 130. The processor can be configured to power the light assembly and thereby illuminate a space for a select period of time (e.g., 30 seconds, 1 minutes, etc.) if no additional motion is sensed besides the initial motion that triggered the operation.

The light assembly 100 can also have a light sensor 140 that detects the light conditions surrounding the unit. The processor can be configured so that the light assembly 100 only operates when certain light conditions are detected by the light sensor 140 and more particularly, when the light sensor 140 detects low light or dark conditions. Thus, even if motion is detected by the motion sensor 130, if the light sensor 140 detects a threshold amount of light, the light assembly 100 will not operate, thereby conserving its power source since illumination by the light assembly 100 is not required in such observed conditions. The light sensor 140 can be any number of different types of commercially available light sensors, such as a photo cell, etc.

As shown, both the motion sensor 130 and the light sensor 140 are disposed along the front face of the front wall 112 and face outward therefrom.

As mentioned herein, the main housing 110 is configured to mate with two different back plates 200, 300 and can be supplied to the consumer as a kit in that the consumer is provided with a single package/box that contains a single main housing (unit) 110 along with one back plate 200 (FIG. 3) and one stake type back plate 300 (FIG. 10) which can be interchangeably used with the main housing 110.

As shown in FIG. 3, the back plate 200 has a rear wall 210 and a partial peripheral side wall 220 that extends along a portion of the rear wall 210. In the illustrated embodiment, the rear wall 210 has a square shape that is complementary to the shape of the main housing 110. The peripheral side wall 220 extends substantially along the two sides of the rear wall 210 and completely along the bottom of the rear wall 210 but is absent along the top of the rear wall 210.

The peripheral side wall 220 has a portion 221 that is perpendicular and integral to the rear wall 210 but also contains a lip 222 that extends inwardly from the portion 221 and thus faces the inside of the rear wall 210. A right angle is formed between the lip 222 and the portion 221. The peripheral side wall 220 can be curved in the two lower corners as shown.

The side sections of the peripheral side wall 220 is configured to be received within the guide notches/cutouts 120 so as to complete the side wall of the housing 110. The back plate 200 is then slid within the guide notches/cutouts 120 until ends 229 of the peripheral side wall 220 contact respective stops 122. It will be seen from the figures, that the mating between the main housing 110 and the back plate 200 provides a clean finished look since the portions 221 of the peripheral side wall 220 occupies the notches 120 formed along the two opposing sides of the main housing 110. The top portion of the rear wall 210 that is located above the ends 229 seats against the top portion of the rear of the main housing 110 that is located above the stops 122.

The real wall 210 of the back plate 200 thus covers the rear of the main housing 110 and thus represents the rear of the light assembly 100. To gain access to the electronics and power source, the user simply reverses the steps and slides the back plate 200 off of the main housing 110. Such action is required to change and replace the batteries.

Figure 7:
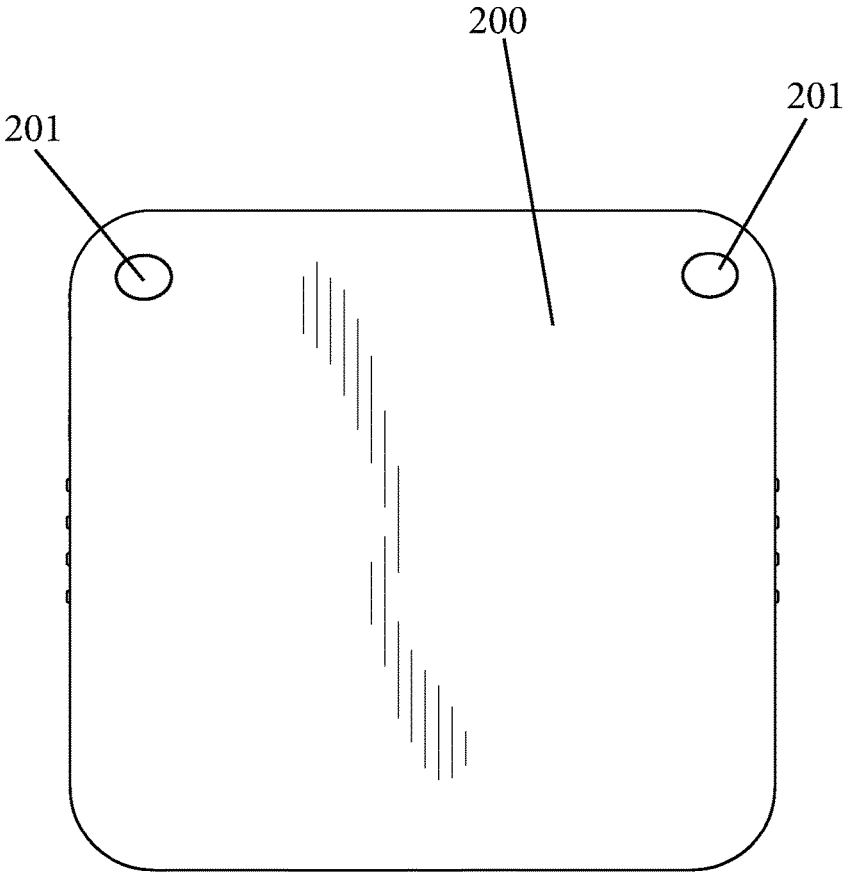
FIG. 7 is a rear elevation view of the light assembly.
Figure 8:
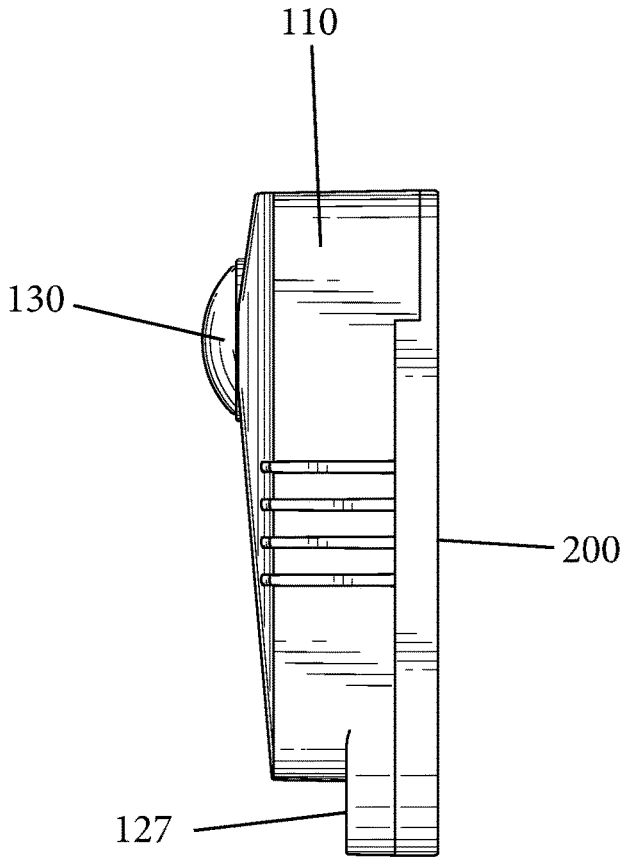
FIG. 8 is a right side elevation view of the light assembly.
Figure 9:
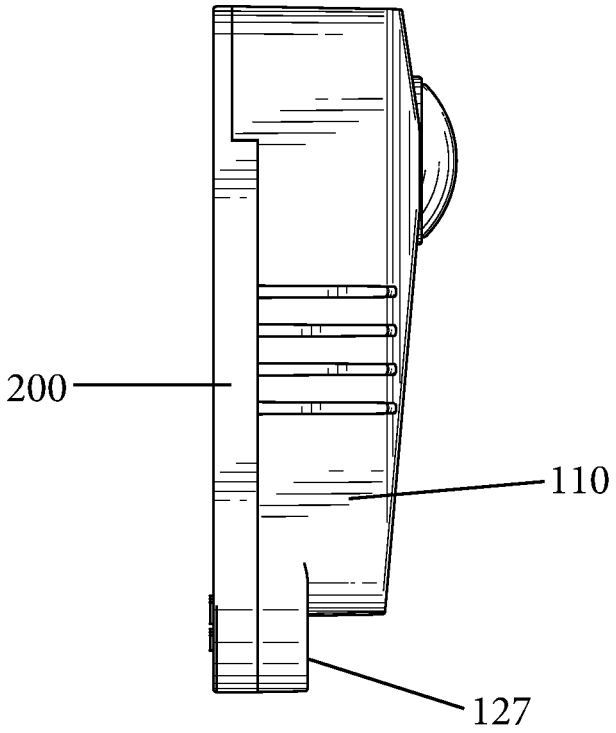
FIG. 9 is a left side elevation view of the light assembly.

To mount the back plate 200 to a support surface, the back plate 200 can contain holes 201 (FIG. 7) that receives fasteners for attaching the back plate 200 to the support surface. For example, two holes 201 can be formed in the top corners. The fasteners can be in the form of screws, nails, etc. that serve to secure the back plate 200 to the support surface.

Alternatively, along the rear face of the back plate 200 one or more adhesive pads can be provided to allow attachment of the back plate 200 to a support surface, such as a wall. The adhesive pad(s) can be a double sided pad in that a first layer of adhesive serves to attach the pad to the rear face of the back plate 200 and a second layer of adhesive has a removable release cover and is designed for being brought into contact with the support surface for attaching the back plate 200 to the support surface. Since the main housing 110 can easily be separated from the back plate 200, the back plate 200 remains in the mounted position on the support surface when the main housing 110 needs to be removed, such as for battery replacement.

FIG. 10 illustrate the alternative back plate construction and in particular, illustrate the stake type back plate 300. The stake type back plate 300 is very similar to the back plate and in fact the back plate 200 forms part of the stake type back plate 300 and therefore, like elements are numbered alike in the drawings. The stake type back plate 300 further includes a stake 310 that extends outwardly (downwardly) from the bottom of the back plate 200. More specifically, the stake 310 extends outwardly from the rear wall 210 of the back plate 200 and is preferably integrally formed therewith.

As shown, the stake 310 is an elongate structure that has a first end 312 that attached to rear wall 210 and an opposing second end 314 that is a free end. The stake 310 can have a tapered construction in that there can be a slight inward taper in the direction toward the second end 314. This facilitates in driving the stake 310 into the ground.

The second end 314 is preferably a pointed end to facilitate driving the stake 310 into the ground. The stake 310 also can include a fluid channel 315 that is in the form of a recessed channel between extends longitudinally along the stake body. The recessed channel 315 is defined between two raised side edges 317. The recessed channel 315 is intended to allow water to drain so water does not pool behind the main light unit and damage the electronics. As shown, the recessed channel 315 communicates with the rear wall of the black plate portion against which the housing 110 seats and thus any water that may collect between the housing 110 and the back plate portion will flow by gravity into the recessed channel 315 and then flow down to the ground away from the electronics.

The stake 310 can further include one or more and preferably, a plurality of ribs 320 formed along the outer surface of the stake 310. Each rib 320 can be a continuous structure that extends along the front, sides, and rear of the stake 310. When plural ribs 320 are provided, they are spaced from one another. The ribs 320 serve to providing the stake 310 with better gripping properties and allow the stake 310 to be better retained within the ground.

It will be appreciated that in the stake type back plate 300, the adhesive pad can be eliminated along the rear face of the back plate 200.

As mentioned, the aforementioned parts can be provided to the consumer as a kit that allows the consumer to have the choice of using the main housing 110 with either the standard back plate 200 or the stake type back plate 300. This provides great versatility to the user.

It will be appreciated that the overhang (the inner wall 125) adjacent the ledge 127 can contain a layer of material, such as a strip of material that serves to reflect the light waves. For example, a reflective plastic strip can be provided at this location and since it faces downward in use, it is not readily visible in many mounting positions of the light assembly 100.

Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

What is claimed:

1. A wireless light comprising:

a housing having an interior compartment that contains electronics and a power source, wherein along a bottom of the housing, a ledge is formed and when the housing is oriented in a vertical position, there is an inner wall adjacent to and overhanging the ledge; and a light source positioned along the ledge and configured to emit light in an outward direction from the ledge, wherein the inner wall is positioned and constructed so as to deflect the emitted light in a downward direction that is away from the inner wall.

2. The wireless light of claim 1, wherein the housing includes a pair of guide rails formed along opposing sides thereof.

3. The wireless light of claim 2, wherein side walls at the opposing sides of the housing include cutouts to provide access to the guide rails, wherein top ends of the guide rails are located adjacent walls that define upper ends of the notches.

4. The wireless light of claim 1, wherein the ledge extends from a first bottom corner to an opposing second bottom corner of the housing.

5. The wireless light of claim 1, wherein the inner wall is formed at a right angle relative to the ledge.

6. The wireless light of claim 1, wherein the inner wall extends across an entire width of the ledge.

7. The wireless light of claim 1, wherein the light source comprises at least one LED that is disposed within the ledge, the at least one LED being positioned and configured such that emitted light rays thereof contact and are deflected downward by the inner wall.

8. The wireless light of claim 7, wherein there is a plurality of LEDs that are spaced across and along the ledge.

9. The wireless light of claim 1, further including at least one sensor selected from the group consisting of a light sensor and a motion sensor.

10. The wireless light of claim 1, further including a back plate that is configured to mate with the housing so as to cover at least a portion of the rear face of the housing.

11. The wireless light of claim 10, wherein the back plate covers the entire rear face of the housing.

12. The wireless light of claim 10, wherein the back plate has a rear wall and a side wall that extends along select locations of a periphery of the rear wall.

13. The wireless light of claim 12, wherein the side wall is U-shaped in that the side wall extends partially along opposing side edges of the rear wall and completely along a bottom edge of the rear wall but not along a top edge of the rear wall.

14. The wireless light of claim 12, wherein the side wall includes a lip that is parallel to the rear wall so as to define a space therebetween, the guide rails of the housing being received within the space when the back plate is slidingly coupled to the housing.

15. The wireless light of claim 10, wherein the back plate has a stake that extends outwardly from one edge thereof.

16. The wireless light of claim 15, wherein the stake is inwardly tapered in a direction toward a pointed free end thereof and includes at least one rib formed along an outer surface of the stake.

17. A wireless light kit comprising:

a wireless light unit that includes:

a housing having an interior compartment that contains a processor and a power source, and a light source that is powered by the power source and operatively connected to the processor;

a first back plate that is configured to mate with the housing so as to cover at least a portion of the rear face of the housing and provide a mounting surface for mounting to a support surface; and a second back plate that is configured to mate with the housing so as to cover at least a portion of the rear face of the housing, the second back plate having a stake extending outwardly therefrom and configured for insertion into a ground surface for supporting the wireless light unit above the ground surface.

18. The kit of claim 17, wherein along a bottom of the housing, a ledge is formed and when the housing is oriented in a vertical position, there is an inner wall adjacent to and overhanging the ledge and the light source is positioned along the ledge and configured to emit light in an outward direction from the ledge, wherein the inner wall is positioned and constructed so as to deflect the emitted light in a downward direction that is away from the inner wall.

19. The kit of claim 17, wherein the stake is inwardly tapered in a direction toward a pointed free end thereof and includes at least one rib formed along an outer surface of the stake.

20. The kit of claim 17, wherein each of the first back plate and the second back plate has a rear wall and a side wall that extends along select locations of a periphery of the rear wall, the side wall being U-shaped in that the side wall extends partially along opposing side edges of the rear wall and completely along a bottom edge of the rear wall but not along a top edge of the rear wall.

* * * * *